US007051900B2

(12) United States Patent
Reeves

(10) Patent No.: US 7,051,900 B2
(45) Date of Patent: May 30, 2006

(54) GAS OPERATED PARTICLE FEED APPARATUS

(76) Inventor: Timothy A. Reeves, 26701 Quail Creek, #267, Laguna Hills, CA (US) 92656

( * ) Notice: Subject to any disclaimer, the term of this patent is extended or adjusted under 35 U.S.C. 154(b) by 43 days.

(21) Appl. No.: 10/952,023

(22) Filed: Sep. 27, 2004

(65) Prior Publication Data

US 2006/0070610 A1 Apr. 6, 2006

(51) Int. Cl.
*B65H 3/60* (2006.01)
*G07F 11/00* (2006.01)

(52) U.S. Cl. ..... 221/200; 221/278; 221/24; 124/51.1; 124/44.7

(58) Field of Classification Search ..... 221/278, 221/277, 24, 203, 200, 124, 197, 154, 258; 124/53.5, 45, 51.1, 72
See application file for complete search history.

(56) References Cited

U.S. PATENT DOCUMENTS 3,869,042 A * 3/1975 Floyd et al. ..... 198/380
4,021,037 A * 5/1977 Torbet ..... 473/431
4,073,280 A 2/1978 Koehn et al.
4,083,349 A 4/1978 Clifford
4,137,893 A 2/1979 Beauchamp
4,207,857 A * 6/1980 Balka, Jr. ..... 124/56
5,752,620 A * 5/1998 Pearson ..... 221/2
6,418,919 B1 * 7/2002 Perrone ..... 124/49
6,502,567 B1 * 1/2003 Christopher et al. ..... 124/51.1
6,889,680 B1 * 5/2005 Christopher et al. ..... 124/51.1

* cited by examiner

*Primary Examiner*—Kathy Matecki
*Assistant Examiner*—Rakesh Kumar
(74) *Attorney, Agent, or Firm*—Dennis W. Beech

(57) ABSTRACT

The gas operated particle feed apparatus may feed particles to an outlet port. There may be a fixed member having a bottom with a particle aperture centrally disposed therein, an annular wall upstanding from the bottom and a plurality of gas apertures. The fixed member may be attached to a base member that may have a central outlet port. A particle outlet element with a constriction aperture may be disposed between the fixed member and the base member. A rotating member with a disk, an agitator, a feed aperture, and a radial disk groove with a ball therein may be disposed in the fixed member and restrained transversally by the wall. Groove apertures may be formed in the disk. A top member may be disposed on the fixed member and may have a central opening. The agitator may protrude through the central opening.

14 Claims, 3 Drawing Sheets

GAS OPERATED PARTICLE FEED APPARATUS

BACKGROUND OF THE INVENTION

This invention relates to apparatus that may be used to feed particles from a particle container to an outlet conduit for discharge from the container. The gas operated particle feed apparatus may be used to feed particles such as, spherical ammunition like B.B. or pellets, rubber bullets and other nonlethal ammunition, from a gas pressurized magazine to be discharged through the barrel of a gun. The feed apparatus may also be used to feed other particle like material, such as, corn and other particle like foods, gravel, medicine in tablet or pill form, and other particulate matter that may be compatible with the apparatus operational structure. For disclosure purposes, the gas powered particle feed apparatus may be described relative to operation of a weapon or gun that may be used as a nonlethal weapon as for example in riot control situations.

Various nonlethal weapons devices that may use gas or air pressure to propel projectiles such as rubber bullets, baton rounds, bean bags and the like have been variously used. Also, weapons that propel marking agents such as paint balls, tear gas, calmatives, maleodorants, flash-bang ordinance, pepper spray and the like may exist and be used for crowd or riot control. Many of these devices may be gas pressure operated, but may not allow for rapid fire of particles or other discharge agents. Other devices may be designed for rapid fire of particles or projectiles such as spherical ammunition, rubber bullets and the like, but the feed mechanism for such weapons may be constrained by complicated magazine loading mechanisms or methods and the feeding of the particles into a barrel of a gun may be susceptible to jamming due to bridging or interference between particles attempting to enter an opening or conduit for discharge through a barrel conduit or barrel.

SUMMARY OF THE INVENTION

The present invention is directed to apparatus for feeding particles to an outlet port. There may be a fixed member having a bottom with a particle aperture centrally disposed therein, a wall upstanding from the bottom and a plurality of gas apertures radially disposed in the bottom. The fixed member may have an indented edge and the fixed member may be attached to a base member that may have a centrally disposed outlet port and may have an indented edge.

A particle outlet element may be disposed between the fixed member and the base member wherein the particle outlet element may have a constriction aperture centrally disposed therein.

A rotating member may be disposed in the fixed member and may be restrained transversally by the wall. The rotating member may have a disk with an agitator on an upper surface and may have a feed aperture centrally disposed therein. There may be a radial disk groove oriented toward the bottom and a generally spherical element may be disposed in the radial disk groove. A plurality of groove apertures may be formed in the disk between the radial disk groove and the upper surface. A top member may be disposed on the fixed member and the top member may have a central opening. There may be a radial groove oriented toward the disk and a plurality of top apertures formed in the top member between the radial groove and a top surface. The agitator may protrude through the central opening.

These and other features, aspects and advantages of the present invention will become better understood with reference to the following drawings, description and claims.

DETAILED DESCRIPTION

Figure 2:
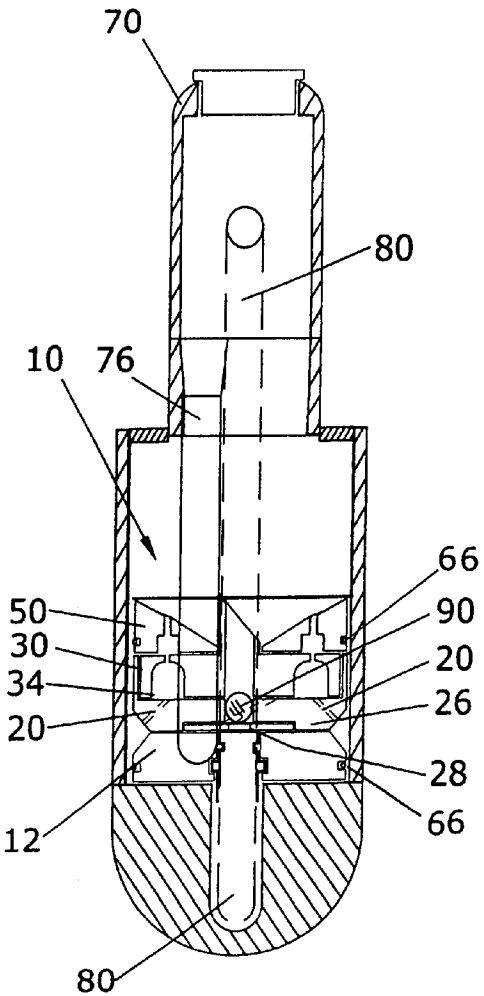
FIG. 2 illustrates an end elevation view of the particle feed apparatus and container according to an embodiment of the invention.
Figure 1:
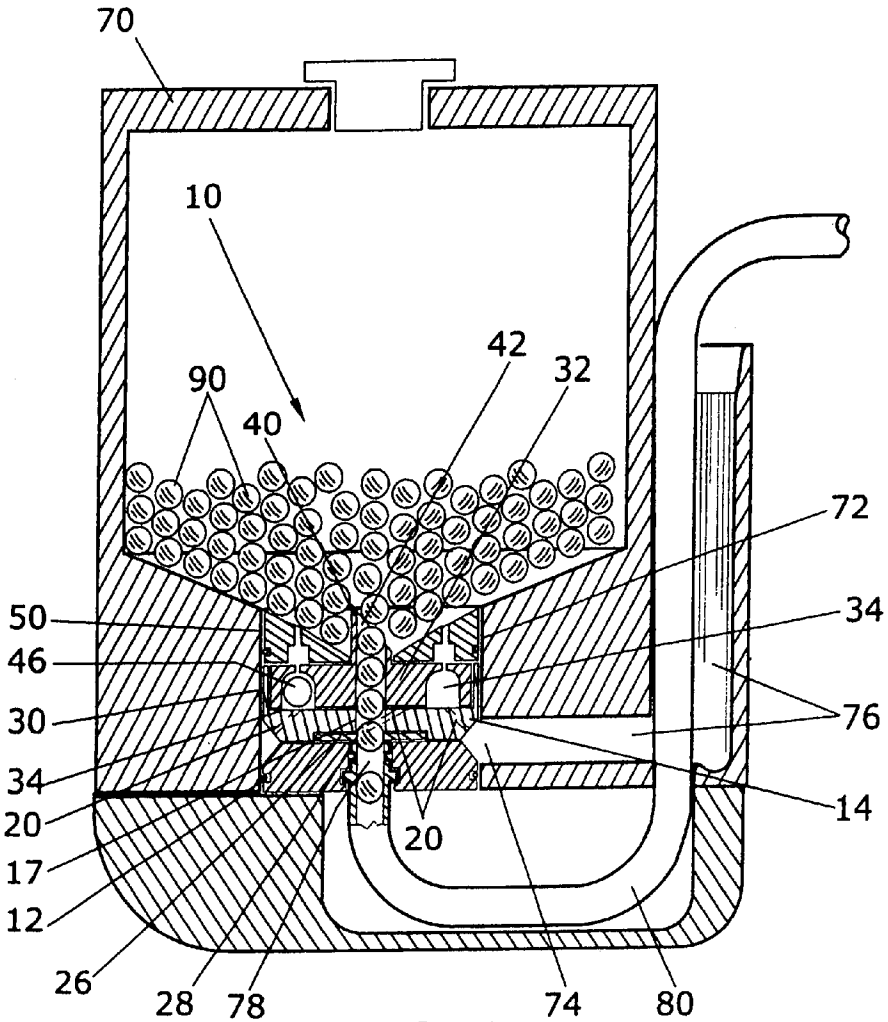
FIG. 1 illustrates a side elevation cross-sectional view of the particle feed apparatus and container according to an embodiment of the invention.
Figure 4:
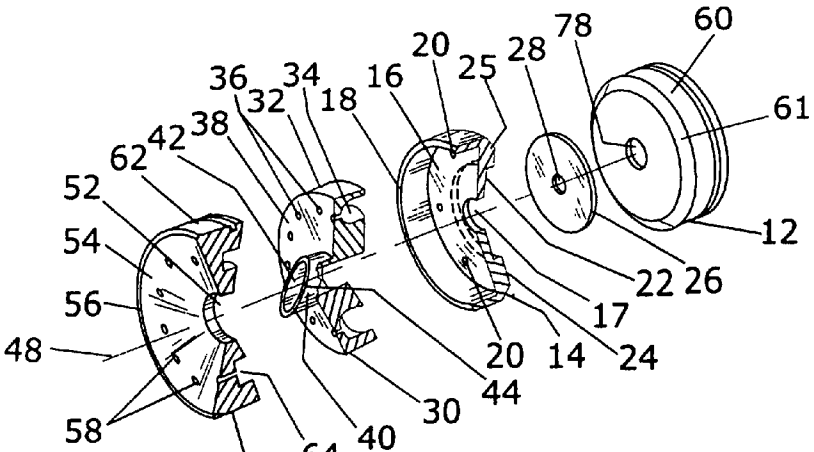
FIG. 4 illustrates a perspective exploded side elevation partial cut away view of the particle feed device according to an embodiment of the invention.
Figure 3:
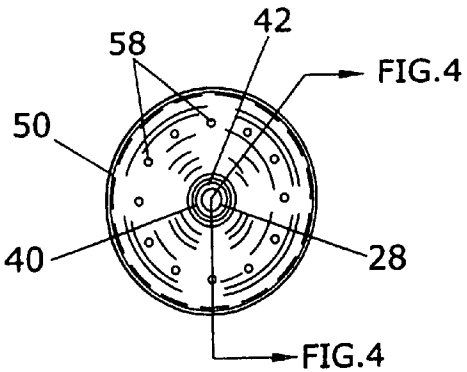
FIG. 3 illustrates a top plan view of the particle feed apparatus according to an embodiment of the invention.

The following detailed description represents the best currently contemplated modes for carrying out the invention. The description is not to be taken in a limiting sense, but is made merely for the purpose of illustrating the general principles of the invention.

Referring to FIGS. 1 through 4, a gas powered particle feed apparatus 10 may have a base member 12 that may be disposed in a container bottom 72 of a particle container 70. The particle container 70 may be a cylindrical, rectangular or other form factor magazine with a container bottom 72 that may be cylindrical, rectangular or other multisided form factor. For purpose of the description, a cylindrical container bottom 72 may be assumed; however, this is not a limiting factor. There may be a fixed member 14 disposed on the base member 12 that may be attached to the base member 12. The fixed member 14 may have a circular bottom 16 with an annular wall 18 attached approximately at the periphery or circumference of the bottom 16 in an upstanding position to generally form a cup. There may be gas apertures 20 formed in the bottom 16 wherein the gas apertures 20 are inclined at approximately the same angle from the horizontal plane of the bottom 16. There may be a particle aperture 17 in the approximate center of the bottom 16.

A rotating member 30 may be positioned in the fixed member 14 for rotational and limited transverse motion within the fixed member 14 relative to a feed rotational axis 48. The rotating member 30 may be a disk 32 of slightly smaller diameter than the annular wall 18. The disk 32 may have a radial disk groove 34 formed therein and may have groove apertures 36 through an upper surface 38 into said radial disk groove 34. There may be an upstanding agitator 40 positioned in the approximate center of the upper surface 38 of the disk 32. There may be a feed aperture 42 through the agitator 40 and disk 32. The agitator 40 may have an inclined wall portion 44 relative to a horizontal plane of the upper surface 38 or other wall structure as may be useful depending on the nature of the particles 90. There may be a spherical element 46 or ball positioned in radial disk groove 34 for motion on circular bottom 16.

The disk 32 may have a peripheral edge that is not circular, for example, the perimeter of the disk 32 may be formed of multiple sides or faces such as five, six or other number that may be straight or curved. The wall 18 may have a member of wall elements joined to form a closed wall 18 with wall elements of a number other than the number of sides of the disk 32. The disk 32 may rotate, pivot or swivel with some transverse motion due to the unequal number of wall elements and intersections relative to the disk 32. The cross-sectional shape of the gas operated particle feed apparatus 10 may be other than circular based on a cylinder. The apparatus 10 may be multisided as described for the wall 18 and various elements or members may be square, octagonal or other cross-sectional shape transverse to the feed rotational axis.

There may be a top member 50 that may be placed on the wall 18 to retain the rotating member 30 in the fixed member 14. The top member 50 may be a circular disk having a central opening 52 through which agitator 40 may protrude. The top surface 54 of the top member 50 may be inclined downwardly from an outer circumference 56 toward the central opening 52 to urge particles 90 to enter the feed aperture 42. There may be top apertures 58 generally vertically formed in the top member 50 as open channels from top surface 54 to an radial groove 64.

The base member 12 and the top member 50 may have annular grooves formed in a side wall 60 and 62 respectively for receipt of an O-ring seal 66. The fixed member 14 may have a circular recess 22, or other recess shape, such as, square, multisided, oval and the like, in a bottom surface 24. A particle outlet element 26, that may be a relatively thin flexible disk having a constricted aperture 28 in the approximate center thereof, may be positioned in the recess 22 intermediate the fixed member 14 and the base member 12.

In operation the particle feed apparatus 10 may be positioned in the bottom of a particle container 70 and attached therein. A gas pressure source (not shown) may be connected to an inlet port 74 by a inlet conduit 76. The inlet port 74 may be tangentially oriented to the longitudinal center line of the base member 12 and fixed member 14 having beveled edges 25 and 61 respectively, or the edges 25, 61 may be indented, notched or the like to form a channel. The beveled edges 25, 61 and bottom 72 walls may form a channel for airflow around base member 12 and fixed member 14. Particles 90 may be placed in the particle container 70 and a particle outlet conduit 80 may be connected to an outlet port 78 in the base member 12. The release of gas from the gas pressure source (not shown) may be controlled by a valve (not shown).

When gas may be released from the gas pressure source, the gas may flow into inlet port 74 to then be channeled through gas apertures 20 to enter the radial disk groove 34 of the rotating member 30. The pressure of the gas flow may cause the ball 46 to move in the radial disk groove 34 thereby urging rotational motion of the rotational member 30 in the fixed member 14. The rotational member 30 may also experience transverse motion in fixed member 14, with the extent of such motion depending on the relative diameters of the wall 18 and the disk 32. The gas flow may exit the radial disk groove 34 through groove apertures 36 and further flow through radial groove 64 and top apertures 58 to enter the particle container 70. The particle container 70 may be a closed chamber device that may be pressurized by the gas flow entering the container.

With the generally circular rotation of the rotating member 30 the agitator 40 may agitate the particles 90 that may be urged to enter the feed aperture 42 under the pressure of the gas. The particles 90 may pass through the feed aperture 42 and particle aperture 17 to rest on the particle outlet element 26 at a constricted aperture 28. When the gas pressure in the container 70 may reach a predetermined value as may be controlled by the flexibility of the particle outlet element 26 and size or shape of constricted aperture 28, a particle 90 may be forced through constricted aperture 28 and into outlet conduit 80. Continued application of gas pressure from a gas pressure source may cause continued discharge of particles into outlet conduit 80.

Referring to FIGS. 5 through 9, in application the particle feed apparatus 10 may be used in a weapon such as a gun 100 to propel particles 90 for discharge from a barrel 102. The particle feed apparatus may be positioned in a gun magazine 104 as previously discussed for a particle container. The gun 100 may have a gas pressure source 106 connected to a gas source conduit 108. There may be a gas source valve 110 intermediate the gas pressure source 106 and the gas source conduit 108 to control the opening and closing of the gas pressure source 106 that may have a poppet valve as an example.

The gas source conduit 108 may be in communication with a trigger device 112 that may also be attached to an inlet conduit 76 of the particle feed apparatus 10. The outlet conduit 80 of the particle feed apparatus 10 may be connected to the chamber end 114 of the barrel 102. The operation of the gun 100 may be controlled by opening the gas source valve 110 to allow gas flow to the trigger device 112. The trigger 116 may then be depressed to release gas pressure into inlet conduit 76 to then apply gas pressure flow to the particle feed apparatus 10 as previously described. When sufficient pressure may be applied, particles 90 may enter the outlet conduit 80 to be channeled to the barrel 102 to be discharged out the muzzle end 118 of the barrel 102.

Figure 5:
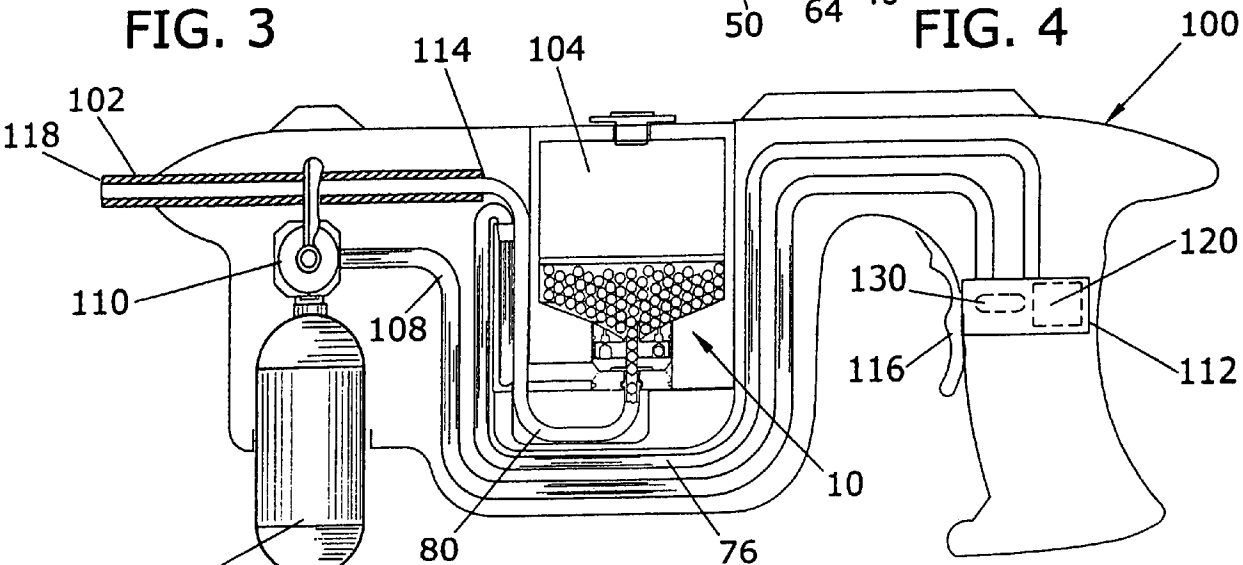
FIG. 5 illustrates a side elevation schematic view of the particle feed apparatus as part of a gas operated weapon according to an embodiment of the invention.
Figure 6:
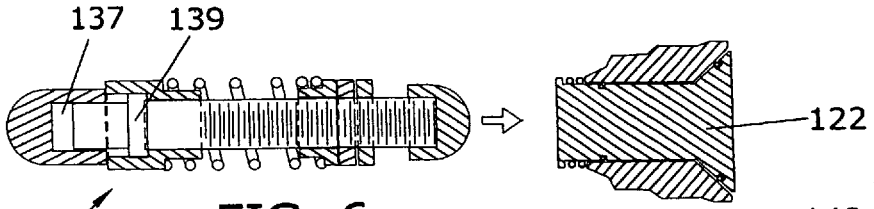
FIG. 6 illustrates a trigger pressure actuator compression apparatus according to an embodiment of the invention.
Figure 7:
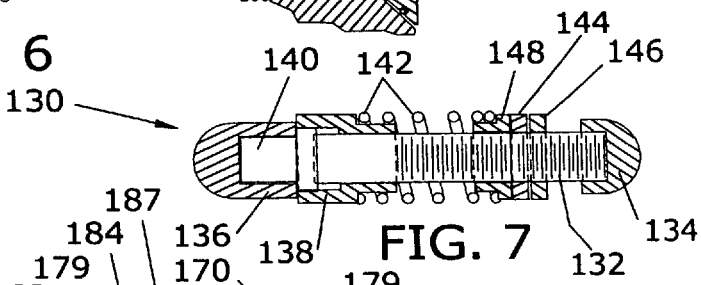
FIG. 7 illustrates a trigger pressure actuator compression apparatus compressed according to an embodiment of the invention.

Referring to FIGS. 5 through 7, the trigger device 112 may have a trigger piston 130 to aid in a user depressing the trigger 116 to operate a trigger valve 120 that may be of a poppet 122 or other form. To initially open the trigger valve 120 may require a particular finger force by a user. If a poppet valve 122 is partially opened, for example, approximately one half inch, there may be reduced force necessary to completely open the poppet valve 122. However, if the user does not completely open the valve there may be gas leakage of insufficient pressure and volume to properly operate the gun 100.

The trigger piston 130 may be disposed between the trigger 116 and the trigger valve 120. The trigger piston 130 may have a threaded actuator shaft 132 with a fixed head 134 and a movable head 136. A compression sleeve 138 may be slidably disposed on the movable end 140 such that a force against movable head 136 causes compression sleeve 138 to move longitudinally on actuator shaft 132. A piston spring 142 may be axially disposed on actuator shaft 132 between the compression sleeve 138 and an adjustment nut 144. A lock nut 146 may be used to retain the adjustment nut 144 in position. A spring follower 148 may also be positioned to slide on the actuator shaft 132 intermediate the piston spring 142 and the adjustment nut 144.

In operation, the trigger piston 130 may be partially compressible by operation of the trigger 116 wherein the piston spring 142 is compressed by movement of movable head 136 and compression sleeve 138. This motion may be stopped by the depth of a movable head cavity 137 or a stop flange 139. Further force on the trigger 116 may cause the poppet valve 122 to be opened by the trigger piston 130. When the poppet valve 122 begins to open gas may begin to exit a gas pressure source thereby reducing gas pressure on the poppet valve 122. However, for optimum gun 100 operation it may be desirable to maximize the amount of gas escaping in order to rapidly increase pressure in the particle feed apparatus 10. The piston spring 142 may be designed to have a force sufficient to quickly, completely open the poppet valve 122 once the valve has been partially opened.

Figure 8:
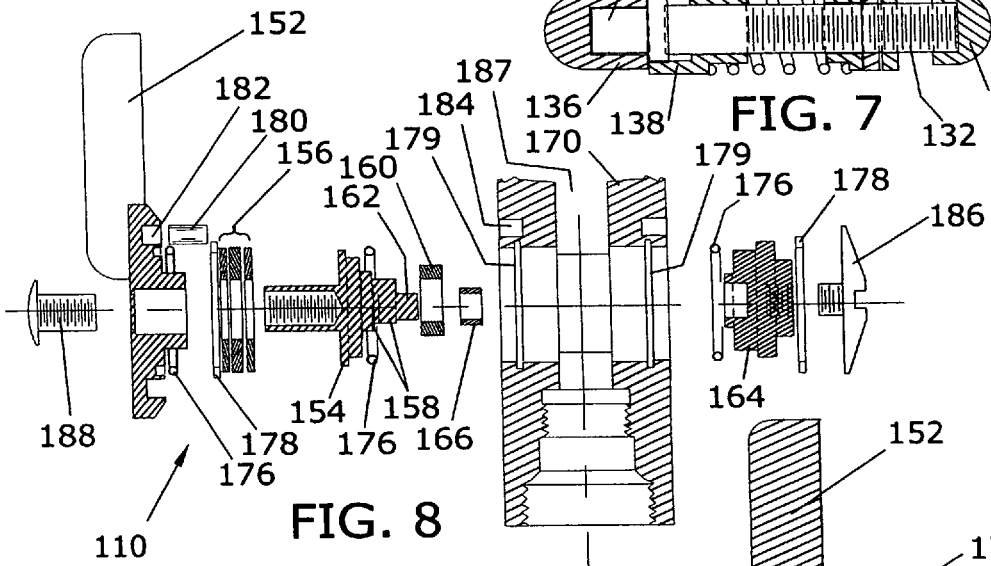
FIG. 8 illustrates an exploded partial cross section view of a gas source valve according to an embodiment of the invention.
Figure 9:
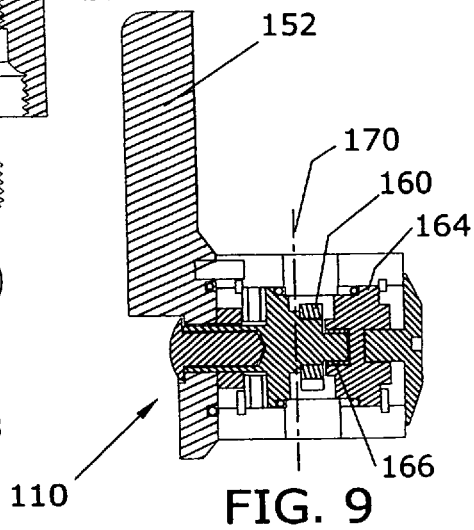
FIG. 9 illustrates a cross sectional side view of the gas source valve according to an embodiment of the invention.

Referring to FIGS. 8 and 9, the gas source valve 110 may be a rotational valve type having a sliding element 150 for engaging the gas pressure source valve that may be a poppet type valve. The valve 110 may have a rotational lever 152 that may be attached to an eccentric rotational element 154. There may be a roller thrust bearing 156 intermediate the rotational lever 152 and the eccentric rotational element 154. There may be a snap ring 178 disposable in a snap ring groove 179 to retain the roller thrust bearing 156 and eccentric rotational element 154 in a housing 170. O-rings 176 may be used for sealing between the rotational lever 152 and housing 170 and the eccentric rotational element 154. The rotational lever 152 may be attached to the eccentric rotational element 154 by a retaining screw 188. A travel limit pin 180 or stop may be disposed in a travel limit recess 184 of housing 170 and positioned to be inserted in a travel limit groove 182 of the rotational lever 152. The travel limit groove 182 may have an annular length to limit the turning of the rotational lever 152 to that necessary to operate the sliding element 150 to open or close a gas pressure source valve.

The eccentric rotational element 154 may have shaft element 158 inserted in ball bearing 160 and shaft end 162 inserted in end cap 164 having end bearing 166. The end cap 164 may be disposed in the housing 170 and retained by a snap ring 178 in a snap ring groove 179. An O-ring 176 may be used for sealing between the end cap 164 and the housing 170. A protective cap 186 may be used to cover the end cap 164. The bearing end 168 of sliding element 150 may abut the ball bearing 160 when gas source valve 110 is assembled in housing 170. The sliding element 150 may be retained in the housing 170 by nut 172. When the rotational lever 152 may be rotated, the shaft element 158 may force the ball bearing 160 against the bearing end 168 to force the sliding element 150 against a gas pressure source valve to force the valve to open and release a gas flow. The sliding element 150 may have slots 174 formed longitudinally therein to allow gas flow along the slide element through housing channel 187 to exit the gas source valve 110 to enter the gas source conduit.

While the invention has been particularly shown and described with respect to the illustrated embodiments thereof, it will be understood by those skilled in the art that the foregoing and other changes in form and details may be made therein without departing from the spirit and scope of the invention.

I claim:

1. An apparatus for gas operated particle feeding of particles to an outlet port comprising:

a fixed member having a bottom with a particle aperture centrally disposed therein, a wall upstanding from said bottom and said bottom having a plurality of gas apertures radially disposed therein;

said fixed member having an indented edge is attached to a base member having a centrally disposed outlet port and having an indented edge, and a particle outlet element is disposed between said fixed member and said base member wherein said particle outlet element having a constricted aperture centrally disposed therein;

a rotating member disposed in said fixed member and restrained transversally by said wall wherein said rotating member having a disk with an agitator on an upper surface thereof and having a feed aperture centrally disposed therein, a radial disk groove oriented toward said bottom and a generally spherical element disposed in said radial disk groove, and a plurality of groove apertures formed in said disk between said radial disk groove and said upper surface; and a top member disposed on said fixed member and said top member having a central opening therein, a radial groove oriented toward said disk and a plurality of top apertures formed in said top member between said radial groove and a top surface, and said agitator protruding through said central opening.

2. The apparatus as in claim 1 wherein there is a recess in a bottom surface of said fixed member for positioning said particle outlet element.

3. The apparatus as in claim 1 wherein said agitator having an inclined wall portion.

4. The apparatus as in claim 1 wherein said top surface is inclined downwardly from an outer circumference toward said central opening.

5. The apparatus as in claim 1 wherein a side wall of said base member and a side wall of said top member have annular grooves formed therein for receipt of an O-ring seal.

6. The apparatus as in claim 1 wherein said plurality of gas apertures are inclined at approximately an equivalent angle relative to a horizontal plane of said bottom.

7. The apparatus as in claim 1 wherein said apparatus is disposed in a bottom of a particle container wherein a gas pressure source is connected to an inlet port by an inlet conduit and an outlet conduit is connected to said centrally disposed outlet port.

8. The apparatus as in claim 7 wherein a plurality of particles are disposed in said particle container.

9. The apparatus as in claim 7 wherein said inlet port is tangentially oriented relative to a feed rotational axis of said base member and said fixed member.

10. The apparatus as in claim 7 wherein said particle container with said apparatus is disposed in a gun having a barrel with a chamber end and a muzzle end, and a trigger in communication with a trigger device having a trigger valve; and said gas pressure source having a gas source valve with a gas source conduit connected between said gas source valve and said trigger valve and said inlet conduit is connected between said inlet port and said trigger valve.

11. The apparatus as in claim 10 wherein a trigger piston is disposed intermediate said trigger and said trigger valve comprising:

a threaded actuator shaft with a fixed head on a first end and a movable head on a second end; and a compression sleeve slidably disposed on said second end having a piston spring axially disposed on said actuator shaft between said compression sleeve and an adjustment nut threadably engaged on said threaded actuator shaft.

12. The apparatus as in claim 11 wherein said movable head having a movable head cavity therein slidably disposed on said second end and slidable movement of said movable head is stopped by a stop flange.

13. The apparatus as in claim 11 wherein there is a spring follower disposed on said threaded actuator shaft intermediate said piston spring and said adjustment nut; and a lock nut is threadably engaged on said threaded actuator shaft and positioned against said adjustment nut.

14. The apparatus as in claim 10 wherein said gas source valve comprising:

a housing;

a rotational lever attached to an eccentric rotational element having a roller thrust bearing intermediate said rotational lever and said eccentric rotational element, and said eccentric rotational element and said roller thrust bearing rotationally disposed in said housing and retained by a snap ring disposed in a snap ring groove;

a travel limit stop disposed in a travel limit recess of said housing oriented for slidable engagement with said rotational lever having a travel limit groove;

said eccentric rotational element having a ball bearing disposed on a shaft element and an end bearing disposed on a shaft end wherein said end bearing inserted in an end cap disposed in said housing; and a sliding element slidably disposed in said housing and retained therein orthogonal to a center line of said eccentric rotational element wherein a bearing end abuts said ball bearing, said sliding element having a longitudinal slot therein, and said sliding element positioned to engage said gas pressure source having a valve therein.

* * * * *